72-455 S8
10/15/85 OR 4,546,638

United States Patent [19]
Field

[11] Patent Number: 4,546,638
[45] Date of Patent: Oct. 15, 1985

[54] APPARATUS FOR REPAIRING AND STRAIGHTENING VEHICLES

[75] Inventor: Carl R. Field, Des Moines, Iowa

[73] Assignee: Duz-Mor, Inc., Des Moines, Iowa

[21] Appl. No.: 433,843

[22] Filed: Dec. 20, 1982

[51] Int. Cl.[4] ..... B21D 1/12
[52] U.S. Cl. ..... 72/455; 72/705
[58] Field of Search ..... 72/455, 457, 705

[56] References Cited

U.S. PATENT DOCUMENTS

| | | | |
|---|---|---|---|
| 2,559,250 | 7/1951 | Jackson | 72/705 |
| 2,717,020 | 9/1955 | Dobias | 72/705 |
| 3,122,194 | 2/1964 | Bronson et al. | 72/705 |
| 3,269,169 | 8/1966 | Latuff et al. | 72/705 |
| 3,377,834 | 4/1968 | Latuff et al. | 72/705 |
| 3,835,692 | 9/1974 | Hoffman | 72/705 |
| 3,888,100 | 6/1975 | Chisum | 72/705 |
| 4,003,239 | 1/1977 | Step | 72/705 |
| 4,151,737 | 5/1979 | Specktor | 72/705 |
| 4,158,303 | 6/1979 | Horn et al. | 72/705 |
| 4,215,849 | 8/1980 | Charland | 72/705 |
| 4,353,241 | 10/1982 | Field | 72/705 |
| 4,386,517 | 6/1983 | Harmon | 72/705 |

FOREIGN PATENT DOCUMENTS

| | | | |
|---|---|---|---|
| 944671 | 4/1974 | Canada | 72/705 |

OTHER PUBLICATIONS

K. J. Master Catalog, Jan. 1977, pp. 1, 8 and 9.

Kansas Jack Collision Repair Equipment, Jan. 12, 1982, pp. 1, 15 and 16.

The New Practi-Pull Mark II, by Guy Chart, (pamphlet), Apr. 1978.

*Primary Examiner*—Lowell A. Larson
*Attorney, Agent, or Firm*—Henderson & Sturm

[57] ABSTRACT

An apparatus for repairing and straightening vehicles includes upper and lower tracks supported in vertically spaced relation by a frame, each track including a pair of laterally spaced apart and longitudinally extending side members. A plurality of tower assemblies are supported on the upper and lower tracks for longitudinal movement therealong. A pit is provided in which cross members support rails positioned directly under side bars of a truck vehicle for a tie-down to extend around the rails and to the vehicle side bars. A longitudinally moveable beam is provided between adjacent lower tracks and the pair of rails and is limited against vertical movement by horizontal flanges facing each other on the tracks and pair of rails. A pulley on the moveable beam engages a tension member extending from the tower to the vehicle to provide a downward pull on the vehicle between the track members and the rails. The structure of the tower assembly allows for pulling on the vehicle frame only at a 90° angle as the pulley on top of the cylinder is limited against turning as is the chain is restricted to one side of the tower by a guide on the tower.

9 Claims, 18 Drawing Figures

3.
4.
10.

APPARATUS FOR REPAIRING AND STRAIGHTENING VEHICLES

BACKGROUND OF THE INVENTION

The present invention is directed generally to apparatus for repairing and straightening vehicles and more particularly to a heavy duty truck straightening apparatus adapted to provide for the facilitated entry of a large truck therein and the application of forces from below and above at sufficient heights to straighten the body thereof.

Several vehicle body straightening apparatus are commercially available but these are generally specially constructed for the repair of automobile bodies and include several heretofore unresolved problems. The existing apparatus such as Chisum U.S. Pat. No. 3,888,100 generally include a plurality of towers moveably positioned about a vehicle with each tower having a chain connected to the vehicle for exerting a pulling force toward the tower. The towers have been supported for revolution about a center pivot point but this arrangement does not accommodate proper positioning of the towers relative to an elongated truck body. FIG. 4 of Chisum shows a push rod 105 mounted on a cylinder 57 with a pull chain 102 anchored to a push rod cap means 103. This structure allows the push rod to turn a full 360° to exert pull on a vehicle frame at any point around the tower. A ring means 123 may be rotated around the tower to position the chain at the desired location. The cylinder cannot be connected directly to the cap 103 since the lateral pull by the chain would damage the piston rod. The chain cannot be attached to the cylindrical means 113 since it needs to be moveable around the tower. Substantial loss of power occurs due to the friction between the push rod and the inside of the cylindrical means due to the lateral pressure created by the pull chain. The length of the chain cannot be easily adjusted since the anchoring point at the cap 103 is too high to reach without a ladder. The ring means is a friction lock arrangment which is not positive and can walk up the tower. Likewise, the towers generally do not provide for the application of forces from sufficient heights to straighten certain truck body parts.

In apparatus wherein the towers are moveably supported on tracks around the vehicle to be straightened, a vertically adjustable ramp or the like is often required for the entry of a vehicle therein. Such an arrangement is impractical for the larger and less maneuverable trucks. Finally, the securement of the towers at desired positions along the track has generally required a bolt or stop pin arrangment which is inconvenient and time consuming to apply for each tower. Latuff et al U.S. Pat. No. 3,377,834 shows a first embodiment including such a stop pin arrangement and a second embodiment wherein a semi-cylindrical portion of the tower bears against a flat track. These and other problems associated with the prior art are believed to be solved by the vehicle repairing and straightening apparatus of the present invention.

Accordingly, it is a primary object of the present invention to provide an improved apparatus for repairing and straighening vehicles.

A further object is to provide a vehicle straighteneing apparatus adapted to accommodate large trucks.

A further object is to provide a vehicle straightening apparatus including means for exerting pulling forces from heights above the towers thereof.

A further object is to provide a vehicle straightening apparatus over a pit which provides access for the operator and wherein the vehicle is stationed on the floor rather than on a platform whereby no stepping up and down from a platform is required.

A further object is to provide a vehicle straightening apparatus which vehicles can easily enter and exit from.

A more specific object is to provide a vehicle straightening apparatus including a two-tiered generally U-shaped track arrangement open at one end for the entry and exit of vehicles therethrough.

A further object of the invention is to provide a vechicle straightening apparatus adapted for easy one-man operation.

A further object is to provide a vehicle straightening apparatus wherein each tower is secured in position along its track by friction between the track and a parallel bearing surface on the tower.

A further object is to provide a portable floor beam adapted to be moved along the length of the apparatus and rotatable for horizontal or vertical forces being applied thereto.

A further object is to provide an overhead hoist moveable the length of the apparatus and to either side.

A further object is to provide a pair of rails directly under the vehicle frame side bars with the rails being supported on cross members extending across the pit whereby tie-down may extend around the rails at substantially any point along the length thereof and be secured to the vehicle side bars.

It is a further object of this invention to provide a vehicle frame straightening apparatus wherein pull on the frame from the adjacent tower is perpendicular thereto as the tower always moves along a track parallel to the side of the vehicle.

A further object of this invention is to provide a tower in which a power cylinder is connected directly at its top end to a pulley carrying a chain anchored on the side of the tower opposite the chain end connected to the vehicle frame such that the pulling action on the tower is always from the same side.

A further object of this invention is to provide a tower comprised of channel members facing each other which enclose and limit rotation of the pulley on top of the cylinder rod with the channels carrying indicia to indicate the cylinder extension position.

A further object of this invention is to provide a tower comprised of two channel members facing each other in which a cylinder rests upon a pair of L-shaped members with the opposite end of the cylinder carrying directly a pair of pulleys over which a chain extends from an anchor on one of the channel members through a guide on the channel member on the opposite side of the tower thence over a pulley and to the vehicle frame.

A further object of this invention is to provide a tower containing a power cylinder which involve a minimum of parts and a minimum of wasted energy through friction during operation.

It is a further object of this invention to provide a tower in which the pulley on the side is positively located at a desired vertical position opposite the vehicle frame and is also positively locked against any rotational movement about the tower.

These and other objects of the present invention will be apparant to those skilled in the art from the following description of the invention.

DESCRIPTION OF THE PREFERRED EMBODIMENT

Figures 1, 2, 10:
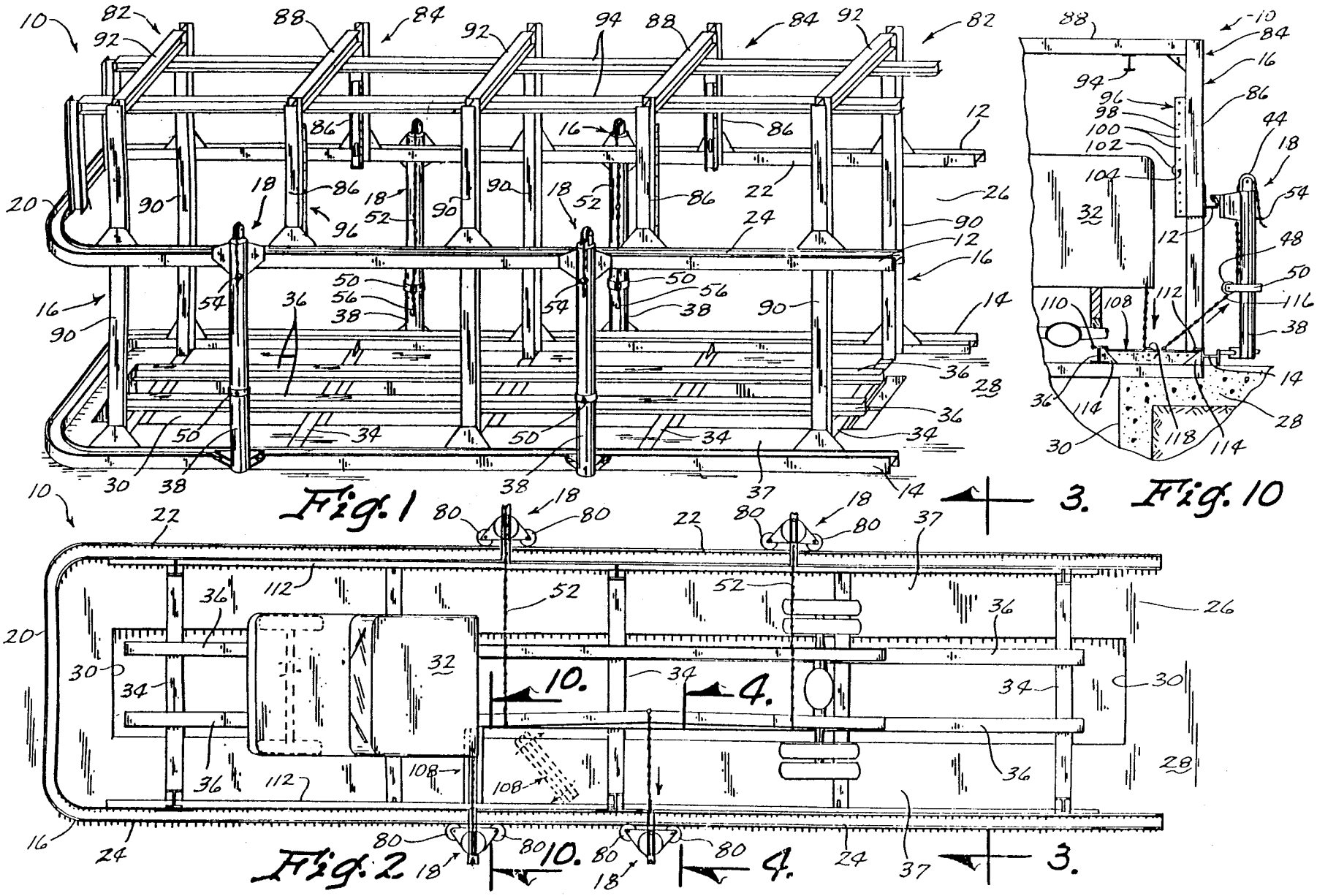
FIG. 1 is a perspective side view of the vehicle straightening apparatus of the invention.
FIG. 2 is an enlarged top view of the vehicle straightening apparatus including a truck chassis positioned therein.
FIG. 10 is a cross-sectional view taken along line 10—10 in FIG. 2 illustrating the use of the portable floor beam.

The vehicle straightening apparatus of the present invention, indicated generally at 10 in FIG. 1, includes upper and lower generally U-shaped tracks 12 and 14 respectively which are supported by longitudinally spaced apart inverted U-shaped frame sections 16. A plurality of upright towers 18 are moveable along the trcks and each includes a chain adapted for connection to a vehicle and means for pulling the chain toward the tower for straightening the vehicle.

In the preferred embodiment, the upper and lower tracks 12 and 14 are substantially identical although it is apparent that in othere embodiments, they may be of different shapes or sizes to accommodate particular tower structures. Only upper track 12 will thus be described in detail with reference to FIG. 2 wherein the track includes a laterally extending from cross member 20 and a pair of side members 22 and 24 connected to opposite ends of the front cross member and extending longitudinally rearwardly therefrom. The rearward end of the track is open as at 26 to provide for the entry of a vehicle into position between the side members 22 and 24.

Figures 3, 4, 5, 6, 7, 8, 9:
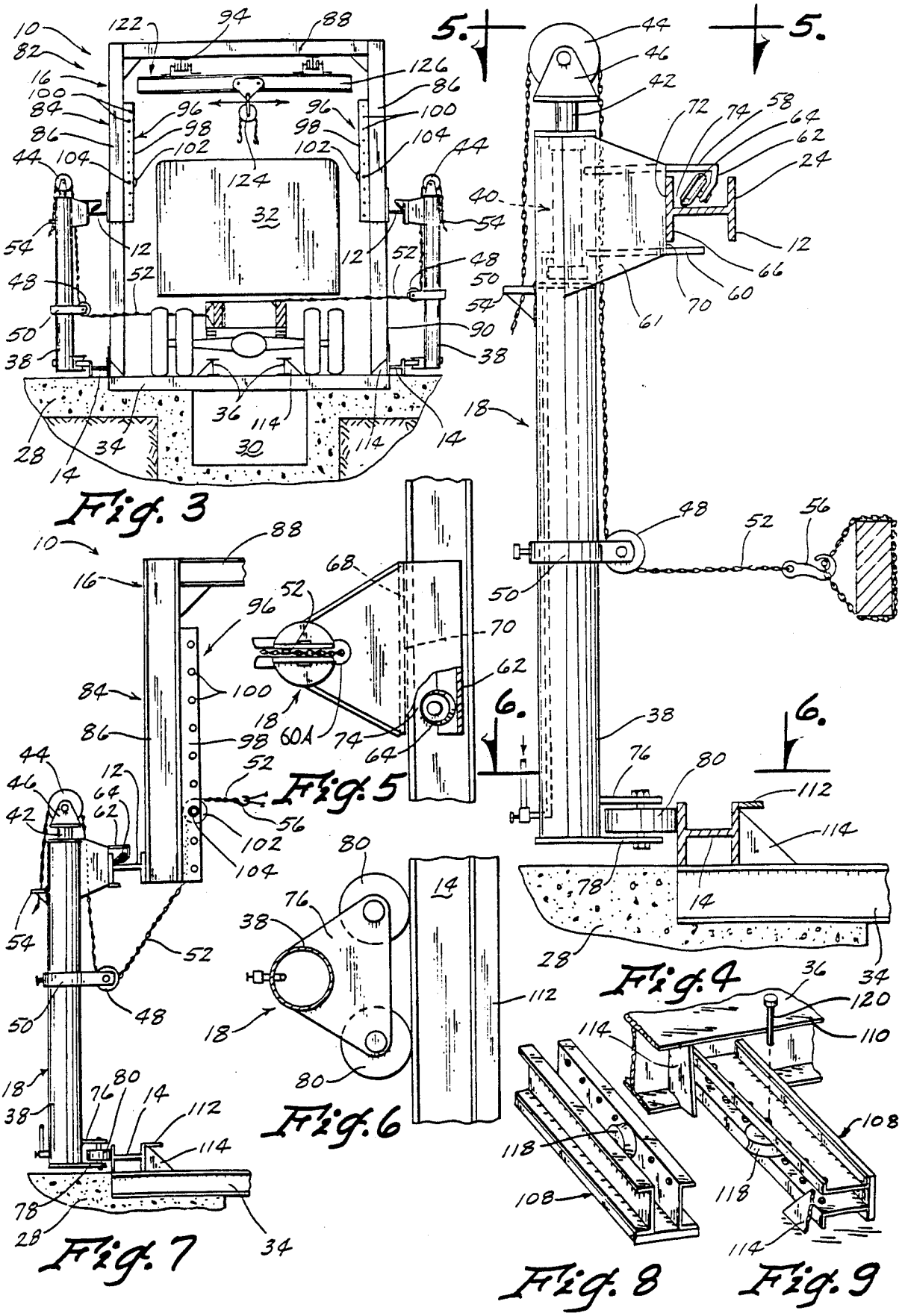
FIG. 3 is a partially sectional elevational end view taken along line 3—3 in FIG. 2.
FIG. 4 is an enlarged detail sectional view of the tower and track arrangement as seen on line 4—4 in FIG. 2.
FIG. 5 is a detailed top view as seen on line 5—5 in FIG. 4.
FIG. 6 is a top partially sectional view of the tower and lower track arrangement as seen on line 6—6 in FIG. 4.
FIG. 7 is an enlarged fragmented end view of one side of the invention.
FIG. 8 is a perspective view of the portable floor beam vertically disposed.
FIG. 9 is a perspective view of the portable floor beam horizontally disposed and engaging gusset plates of beams mounted in the floor.

In FIGS. 1 and 3, it is seen that the apparatus 10 is constructed on a foundation 28 including an elongated pit 30 positioned between the track side members for providing access to the underside of a truck 32 positioned within the apparatus. A plurality of cross members 34 extend laterally across the top of pit 30 for supporting a pair of longitudinally extended rails 36 which are spaced apart by the same distance as the side bars of most large truck frames. The rails are convenient for applying vertical tie-downs to the truck for certain straightening operations. There is sufficient clearance between the sides of pit 30 and the side members of lower track 14 to permit a vehicle to be driven into the apparatus with its wheels supported on the surface 37 therebetween. Since the rails 36 are supported only by the cross members 34 extending over the pit the substantial length of the rails is exposed for extending the tie-downs completely around the rails at any desired position for applying a tension force to the vehicle side bars.

Each tower or tower assembly 18 includes an upright tubular base member 38 which houses an extensible and retractable hydraulic cylinder unit 40 therein. The piston 42 protrudes from the upper end of base member 38 and has a first pulley 44 rotatably mounted on the upper end thereof by a bracket 46. A second pulley 48 is rotatably supported about a horizontal axis on the interior side of base member 38 by a vertically adjustable collar 50. The terms interior and exterior are used herein with reference to the apparatus 10 so that interior means toward a vehicle positioned within the apparatus. A flexible tension member 52 such as a chain, wire cable or the like is secured at one end to an anchor lock bracket 54 on the exterior side of base member 38 with a medial portion of the chain trained about the top side of first pulley 44 and underside of second pulley 48 for extension of the free end 56 thereof interiorly for connection to the truck 32. Upon extension of hydraulic cylinder unit 40, the free end 56 of chain 52 is pulled toward the second pulley 48 for straightening the truck frame. In FIG. 2, it is seen that a pair of towers on one side of the apparatus 10 have chains connected to the truck for stabilizing the same so that the pulling force of the tower on the opposite side of the apparatus is directed toward the damaged area of the vehicle. Since the towers are moveable to any position opposite any point on the frame which the chain is to be secured there is no need for pulling at an angle to the tower and therefore all pulls can be perpendicular to the vehicle frame.

To support each tower 18 on the upper and lower tracks 12 and 14, the upper end of each base member 38 includes a pair of vertically spaced apart interiorly flared plates 58 and 60 which are welded to the base member and reinforced by vertical gussets 61.

As seen in FIG. 5, the chain 52 extends downwardly through a guide opening 60A formed in each of the vertically spaced apart plates 58 and 60. In FIG. 4 it is further seen that the vertical gussets 61 extend further along the chain 52 and function as a continuation of the guide opening 60A and thereby disallow any lateral movement of the chain 52 around the tower. The chain extending over the pulley 44 locks the pulley against rotation about a longitudinal axis through the tower and thus maintains the pulley in a common vertical plane with the chain extending down opposite sides of the tower as seen in FIGS. 4 and 5.

Top plate 58 includes a down turned and exteriorly bent end portion 62 which rotatably supports a pair of longitudinally spaced apart rollers 64 on the exterior side thereof. In FIG. 4 it is seen that the rollers 64 ride on the horizontal web of the I-beam shaped upper track 12 for vertically supporting the tower 18 thereon. Since both upper and lower plates 58 and 60 extend interiorly of at least a portion of upper track 12, the vertical movement of the tower is additionally limited by the abutment of these plates with the exterior vertical side flange 66 of upper track 14 although rollers 64 normally support the tower so that both plates are maintained in clearance relation from flange 66.

An additional vertical plate 68 having an interior bearing surface 70 is secured between plates 58 and 60 adjacent the upper track exterior flange 66. It is seen that vertical plate 68 limits interior movement of tower 18 by bearing against the exterior friction surface 72 of upper track flange 66. Upon the application of tension to the chain 52 by the extension of hydraulic cylinder unit 40, sufficient friction is developed between the tower bearing surface 70 and the track friction surface 72 to secure the tower in a fixed longitudinal position along the upper track 12. This is largely due to the parallel relation and relatively large area of the surfaces which become engaged when the tower is urged toward the rail by chain 52.

On the other hand, when tension is not being applied to the chain 52, the tower 18 is easily rolled along the upper track 12 substantially free from friction from the surfaces 70 and 72. This is because of the clearance space 74 between the roller 64 and exterior track flange 66 (FIG. 4) which permits of sufficient exterior movement of the tower to separate the surfaces 70 and 72.

The lower end of tower 18, as shown in FIGS. 4 and 6, includes a pair of interiorly flared wheel support plates 76 and 78 between which a pair of horizontally disposed rollers 80 are supported about vertical axes at longitudinally spaced apart positions for rolling engagement against the exterior surface of lower track 14.

It is important to be able to vertically adjust the position from which a pulling force is exerted on the truck 32. Since the truck may be taller than the towers 18, however, the vertical adjustment of collars 50 is insufficient to provide the necessary range of vertical adjustment. For this purpose, the frame of the present invention includes a superstructure indicated generally at 82 which extends upwardly above the upper track 12. Referring to FIGS. 1 and 3, the superstructure 82 includes a plurality of inverted generally U-shaped pulley support sections 84, each including a pair of upper post 86 secured to opposite members of the upper track 12, and a top frame member 88 connected to and extended between the tops of the upper posts 86. Note that the frame sections 16 also include upright frame posts 90 secured to the interior side of the upper and lower tracks 12 and 14 and extended upwardly from the upper track, and a top frame member 92 connected between opposite frame posts. A pair of elongated brace members 94 interconnect the top frame members 88 and 92 for reinforcing the same.

Each upper post 86 includes an upright channel section 96 (FIG. 7) on the interior side thereof which opens toward the opposite upper track side member. Each channel section 96 includes spaced apart side flanges 98 which may be formed by a pair of oppositely disposed channel members as indicated in FIG. 8. The side flanges 98 are provided with vertically spaced openings 100. An upper pulley 102 is rotatably supported between a selected pair of openings 100 by a pin 104.

In FIGS. 2 and 8–10 the portable beam 108 is positioned between the lower track 14 and the adjacent rail 36 by its ends being placed under the flange 110 on the rail 36 and under an add-on flange 112, best seen in FIG. 7, extending horizontally inwardly from the top side surface of the lower track 14. Gussets 114 spaced along the length of the lower track and rails 36 provides stops against which the portable beams abut to limit horizontal travel. The beams 108 are easily put in place or removed by simply turning them sufficiently to engage or disengage the lower track and rails 14 and 36, respectively, as seen by the dash line representation of the portable beam in FIG. 2.

In FIG. 10 it is seen that a chain 116 extends from the truck cab 32 downwardly around a pulley 118 on the beam 108 thence upwardly and outwardly to a pulley 48 wherein the pull is applied as previously discussed. The pulley 118 is adapted to be positioned anywhere along the length of the beam 108 by use of the removable pin 120. In FIG. 9 it is seen that the beam 108 is turned 90° then is abutted up against the gussets 114 which function as a stop to resist horizontal movement. Horizontal and vertical forces can be applied to the portable beam 108 in this position.

In FIG. 3 an overhead hoist assembly 122 is provided and includes a chain 124 moveably carried on a transversely extending beam 126 which in turn is moveable longitudinally on the rail members 94. Thus, lifting forces may be applied to the vehicle 32 at any point along its length or width.

Thus, referring to FIG. 7, it is seen that the chain 52 may be extended upwardly from second pulley 48 to be trained about the top side of upper pulley 102 for exerting a pulling force on the truck 32 from an elevation above the upper track 12.

The term pulley is intended to be broadly construed as including gears, sprockets or other such rotatable members as may be provided for effecting a change in direction of the chain 52 or other such flexible tension member as may be provided.

The apparatus for repairing and straightening vehicles according to the present invention is particuarly adapted for the repair of large trucks. The two-tiered and open ended U-shape of the tracks enables the trucks to be driven into and out of the apparatus at ground level and without interference from either track. An operator can quickly roll the towers along the tracks to the desired positions for connection of the chains to the truck body. Upon the application of tension to the chain of a given tower by the extension of the hydraulic cylinder unit of the same or an oppositely disposed tower, the tower is secured against longitudinal movement along the tracks by the frictional bearing engagement between the tower bearing surface 70 and the upper track friction surface 72. Similarly, once the tension in the chain is relaxed, the limited lateral freeplay of the tower relative to the track enables the contact surfaces to separate so that the towers may again be easily moved to alternate positions for another operation. Finally, the superstructure 82 including the overhead hoist assembly 122, combined with the portable beams 108, enables the chains to exert pulling forces on the truck body directly upwardly or downwardly or from the side at any desired elevation including the points above the height of the towers as is often necessary for repairs to truck bodies.

Figure 11:
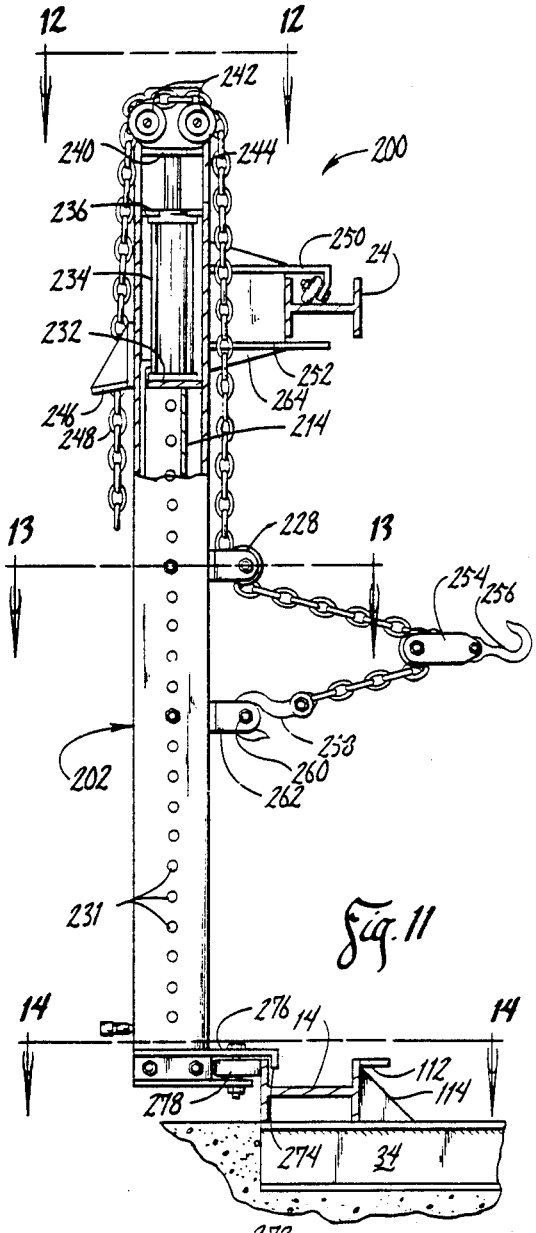
FIG. 11 is a fragmentary side elevational view of an alternate tower similar to the tower of FIG. 4.
Figure 12:
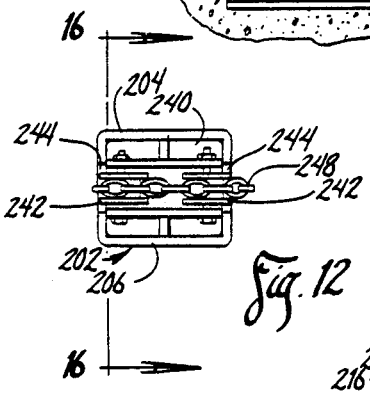
FIG. 12 is a cross-sectional view taken along line 12—12 in FIG. 11.
Figure 14:
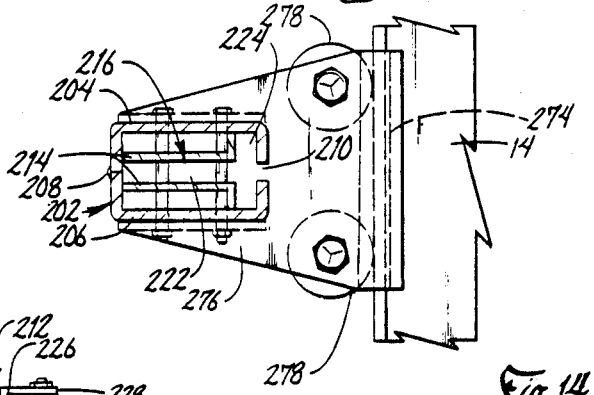
FIG. 14 is a cross-sectional view taken along line 14—14 in FIG. 11.
Figure 13:
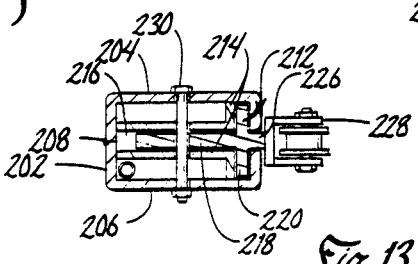
FIG. 13 is a cross-sectional view taken along line 13—13 in FIG. 11.

It should be noted that as seen in FIG. 2, the chains 52 connected to the towers 18 extend perpendicularly inwardly rather than at an angle since there is no need for any angular pulls on the towers as the towers can be moved to any position directly opposite to the connection to the vehicle. Accordingly, the towers do not need to rotate to allow for angular pulls but instead are simply moved to a point directly opposite the connection to the vehicle. In this regard the pulley bracket 46 and the collar 50, as seen in FIG. 4, can be locked against rotational movement as such is not required for operation of the towers 18. An alternate tower is disclosed in FIGS. 11–17 and is referred to generally in FIG. 11 by the reference numeral 200.

An enclosure 202 is provided by welding together a pair of channels 204 and 206 along adjacent edges 208 while leaving an access slot 210 on the opposite side in which a pulley bracket 212 is moveably positioned. A pair of L-shaped plates 214 are positioned in the rectangular enclosure and form a pasageway 216 therebetween for the pulley bracket 212. The walls of plates 214 and the walls of channels 204 and 206 which form T-shaped passageway 216 serve as guide surfaces for guiding pulley bracket 212. The pulley bracket 212 is cross shaped and includes a stem 218 and a cross 220. The passageway 216 is T-shaped and includes a portion 222 for the stem 218 and a portion 224 for the cross 220. A stem extension 226 extends through the slot 210 and carries a pulley 228. A bolt 230 locks the pulley bracket 212 in the desired vertical position by extending through vertically aligned selected openings 231 in the opposite enclosure sidewalls and through the plates 214 and the pulley bracket stem 218.

Figure 16:
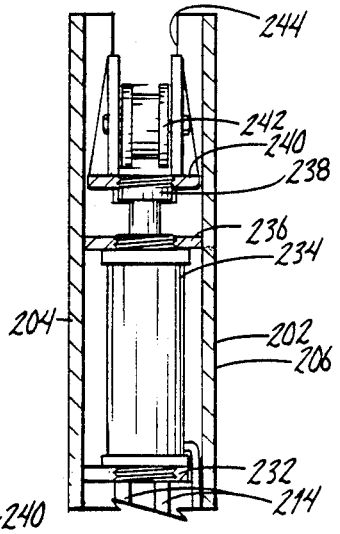
FIG. 16 is a cross-sectional view taken along lines 16—16 in FIG. 12.
Figure 17:
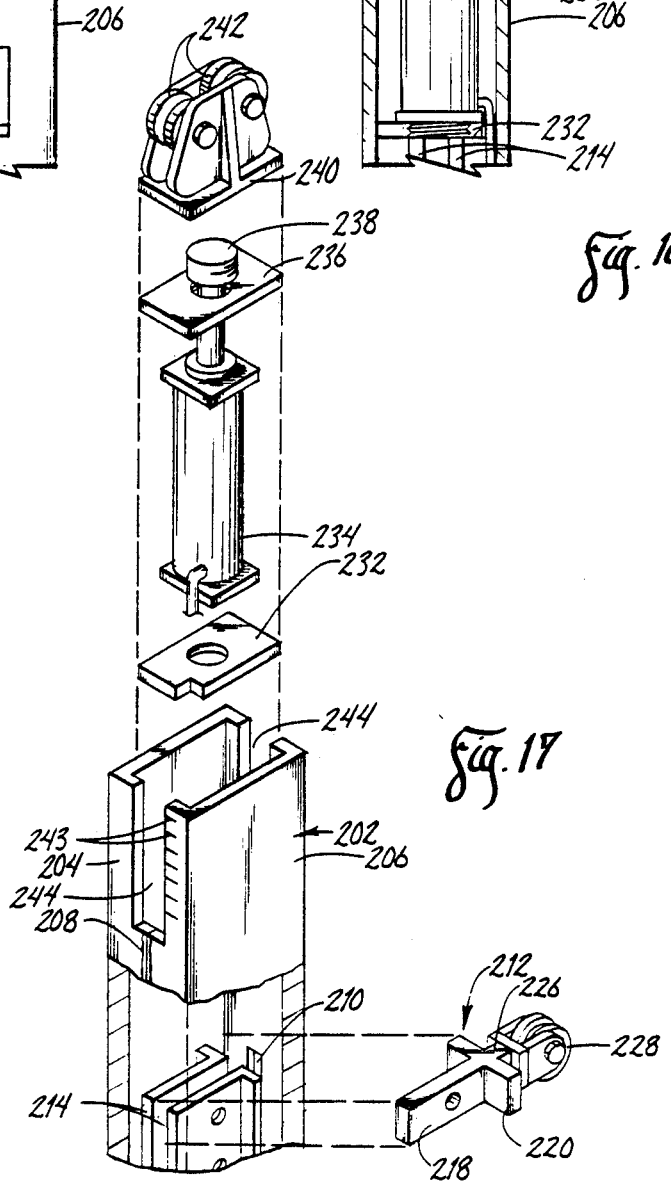
FIG. 17 is an exploded perspective view of the tower.

As seen in FIG. 16, the L-shaped plates provide a support surface for a hydraulic cylinder base plate 232 threadably mounted on the lower end of the hydraulic cylinder 234. A corresponding rectangular plate 236 is threadably secured to the upper end of the hydraulic cylinder and the two plates lock the cylinder in position within the enclosure.

The upper end 238 of the hydraulic cylinder shaft threadably engages a pulley bracket plate 240 carrying two pulleys 242. Each of the plates 232, 236 and 240 are rectangular in shape corresponding to the interior shape of the enclosure and the enclosure sidewalls extend the substantial length of the hydraulic cylinder travel as seen in the extreme positions of use in FIGS. 15 and 16 thus providing protection for the cylinder and limiting the pulley bracket from rotating about the longitudinal axis of the enclosure stroke extension measuring indicia 243 as seen in FIG. 15.

Figure 15:
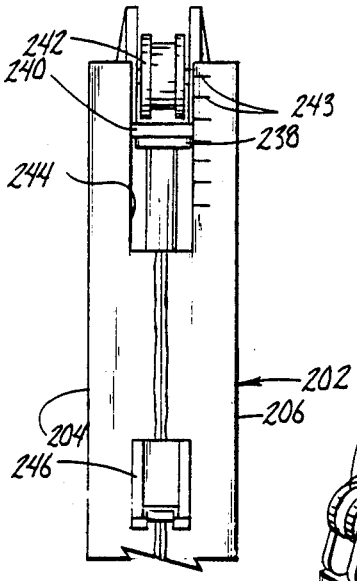
FIG. 15 is a fragmentary side elevational view of the top end of the tower as seen from the left in FIG. 11.

As seen in FIGS. 15 and 16 oppositely disposed vertical slots 244 are provided for the rollers 242 for the length of their travel when the cylinder is expanded and contracted.

A stop anchor lock bracket 246 is mounted on the enclosure to adjustably secure one end of a chain 248 which is threaded over the top of the rollers 242 and down the opposite side through the horizontally disposed plates 250 and 252 and finally through the pulley 228 and thence to the vehicle frame through a pulley 254 having a hook 256. The distal end of the chain 248 is secured to the post by a hook 258 engaging a pin 260 on a pulley bracket 262 similar to the bracket 212 for the pulley 228. This arrangement allows for doubling the pull on the vehicle frame compared to securing the hook 258 directly to the vehicle frame.

The plates 250 and 252 are further strengthened by the vertical gusset plates 264 and as seen in FIG. 4 support the tower on the track 24.

Figure 18:
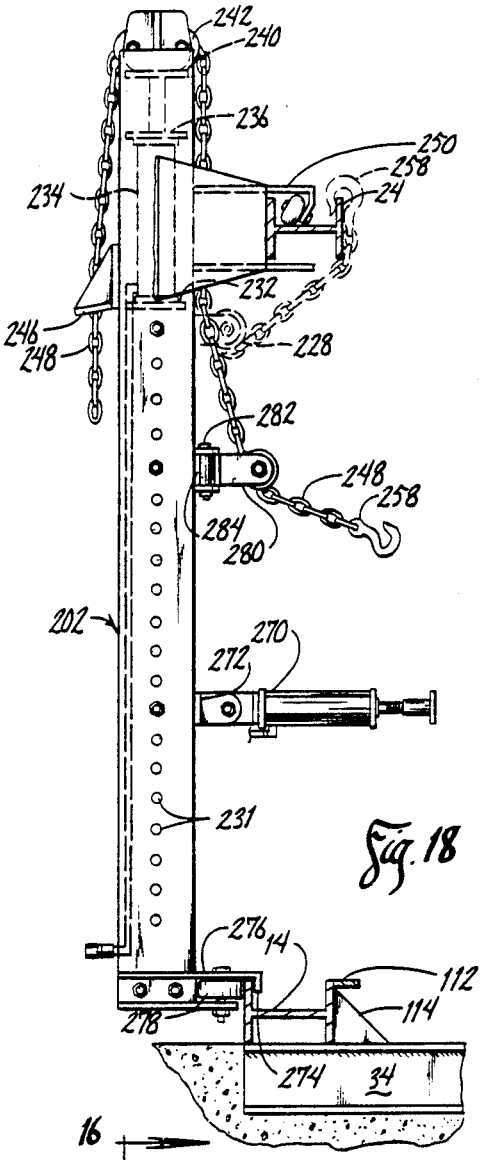
FIG. 18 is a view similar to FIG. 11 illustrating how the tower is used to apply pressure to the side of the vehicle through use of a jack positioned between the tower and the vehicle frame.

As seen in FIG. 18 a different pulling action is provided through use of the chain 248 wherein the hook 258 is secured to a flange of the track 224 after the chain passes through the pulley 228 as seen by the dashline position of the pulley and the chain. This arrangement allows a jack 270 mounted on a pulley bracket 272 to push against the vehicle frame while the lower end of the tower is locked to the track 14 by a downwardly extending leg 274 being provided on the top bracket 276 for the roller 278 engaging the track 14.

It is further seen that a swivel pulley asembly 280 is shown in FIG. 18 and allows for approximately 30° of pivotal action about a pin connection 282 to a pulley bracket 284.

Thus it is seen that a simplified tower construction is provided which totally protects the cylinder 234 against any strain which might cause damage even though the pulleys 242 are mounted directly to the outer end 238 of the cylinder shaft without the use of a push rod or the like. The anchoring of the chain 248 to the tower enclosure rather than to the plate 240 on which the pulleys 242 are mounted stabilizes the pulleys against lateral displacement thus avoiding strain on the cylinder shaft. The chain anchor 246 is positioned close enough to the ground that the length of the chain may be readily adjusted by the operator from the ground without stepping on a ladder or the like. The pulley 228 is positively locked to the tower by a bolt connection and thus there is no way it can work its way up the tower during use.

Thus there has been shown and described an apparatus for repairing and straightening vehicles which accomplishes at least all of the stated objects.

I claim:

1. Apparatus for repairing and straightening vehicles comprising:

vehicle supporting means for receivingly supporting the wheels of a vehicle;

cage means attached to said wheel receiving means for surrounding a vehicle disposed on said vehicle supporting means, said cage means having an upper portion having an upper outer periphery thereof, a lower portion having a lower outer periphery thereon and support means interconnecting said upper and lower portions;

tower means operably attached to said cage means for providing anchor points for pulling against auto body parts, said tower means having an upper portion and a lower portion;

upper track means disposed around a subtantial portion of the upper periphery of said cage means;

means for operably attaching a lower portion of said tower means to said lower track means for permitting said lower portion of said tower to be guided around along said lower track means;

said tower means comprising a substantially vertically disposed beam, said beam including an inner wall facing said cage means, an outer wall facing away from said cage means and two side walls interconnecting said inner wall and outer wall, a space being formed between said inner wall, outer wall and side walls, guide surfaces being formed within said inner, outer and side walls, a vertically oriented slot being disposed in and through said inner wall;

flexible means for attachment to said tower at one end thereof and to a vehicle body part on the other end thereof for pulling on such auto body part, said flexible means being tensionable;

holding means operably attached to said outer wall for attaching said one end of the flexible means thereto;

first guide roller means operably attached to a top portion of said beam for receivingly guiding said flexible means over the top of said beam;

hydraulic cylinder means fixed on one end thereof with respect to said beam for selectively varying the distance between said roller means and said flexible holding means to selectively exert a pulling force on the other end of said flexible means;

second guide roller means for receivingly guiding said flexible means;

bracket means for rotatably attaching said second roller means to said beam;

extension means connected to said bracket means and extending through the slot in said inner wall of the beam;

guide means disposed inside of said inner, outer and side walls of said beam for cooperating with said guide surfaces, said guide means being connected to said extension means for permitting said extension means and bracket means to be vertically moved with respect to said beam; and locking means for selectively locking said guide means in any one of a number of vertically spaced positions.

2. The apparatus of claim 1 wherein said locking means comprises an opening in said guide means, a plurality of pairs of aligned holes in the side walls of said beam and pin means for selectively being received through any one of said pair of holes and said opening to prevent vertical movement of the guide means with regard to said beam.

3. The apparatus of claim 1 including pivot means operably attached to said bracket means and said extension means for permitting said bracket means to pivot about a substantially vertical axis to insure that the second guide roller means is in proper alignment.

4. The apparatus of claim 1 wherein said guide means has a vertical dimension sufficient to prevent consequential pivoting of said guide means within said beam.

5. The apparatus of claim 1 wherein said first guide roller means includes a first roller rotatably disposed directly above said inner wall and a second roller rotatably disposed above said outer wall.

6. The apparatus of claim 1 including means for permitting said guide means and said holding means to be moveable with respect to each other.

7. The apparatus of claim 1 including means for preventing said guide means from pivoting with respect to said beam.

8. The apparatus of claim 1 including means for preventing said guide means from rotating with respect to said beam.

9. Apparatus for repairing and straightening vehicles comprising:

vehicle supporting means for receivingly supporting the wheels of a vehicle;

tower means operably attached to said vehicle supporting means for providing anchor points for pulling against auto body parts, said tower means having an upper portion and a lower portion, said tower means comprising a substantially vertically disposed beam, said beam including an inner wall facing said vehicle supporting means, an outer wall facing away from said vehicle supporting means, and two side walls interconnecting said inner wall and outer wall, a space being formed between said inner wall, outer wall and side walls, guide surfaces being formed within said inner, outer and side walls, a vertically oriented slot being disposed in and through said inner wall;

flexible means for attachment to said tower at one end thereof and to a vehicle body part on the other end thereof for pulling on such auto body part, said flexible means being tensionable;

holding means operably attached to said outer wall for attaching said one end of the flexible means thereto;

first guide roller means operably attached to a top portion of said beam for receivingly guiding said flexible means over the top of said beam;

hydraulic cylinder means fixed on one end thereof with respect to said beam for selectively varying the distance between said roller means and said flexible holding means to selectively exert a pulling force on the other end of said flexible means;

second guide roller means for receivingly guiding said flexible means;

bracket means for rotatably attaching said second roller means to said beam;

extension means connected to said bracket means and extending through the slot in said inner wall of the beam;

guide means disposed inside of said inner, outer and side walls of said beam for cooperating with said guide surfaces, said guide means being connected to said extension means for permitting said extension means and bracket means to be vertically moved with respect to said beam; and locking means for selectively locking said guide means in any one of a number of vertically spaced positions.

* * * * *